US007756431B2

(12) United States Patent
Kitano

(10) Patent No.: US 7,756,431 B2
(45) Date of Patent: Jul. 13, 2010

(54) IMAGE FORMATION APPARATUS WITH CONTROLLED DISCHARGE CURRENT

(75) Inventor: Yoshihisa Kitano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 939 days.

(21) Appl. No.: 11/529,433

(22) Filed: Sep. 29, 2006

(65) Prior Publication Data

US 2007/0166066 A1 Jul. 19, 2007

(30) Foreign Application Priority Data

Jan. 18, 2006 (JP) ..... P2006-009949

(51) Int. Cl.
*G03G 15/02* (2006.01)
*G03G 15/00* (2006.01)

(52) U.S. Cl. ..... 399/50; 399/89

(58) Field of Classification Search ..... 399/50, 399/89, 115

See application file for complete search history.

(56) References Cited

U.S. PATENT DOCUMENTS 5,805,954 A * 9/1998 Takahashi ..... 399/44
6,539,184 B2 * 3/2003 Shimura et al. ..... 399/50
2003/0081959 A1 * 5/2003 Komori ..... 399/50
2004/0141772 A1 * 7/2004 Goto ..... 399/222
2005/0002681 A1 * 1/2005 Takahashi et al. ..... 399/50
2005/0111869 A1 * 5/2005 Takami et al. ..... 399/89
2005/0117944 A1 * 6/2005 Kawada et al. ..... 399/349

FOREIGN PATENT DOCUMENTS

JP 2002-72633 3/2002
JP 2004-333789 11/2004

* cited by examiner

*Primary Examiner*—David M Gray
*Assistant Examiner*—Rodney Bonnette
(74) *Attorney, Agent, or Firm*—Morgan, Lewis & Bockius LLP

(57) ABSTRACT

An image formation apparatus that includes a photoconductor, a charging section that applies a bias voltage having an AC voltage superposed on a DC voltage and charges the photoconductor, a controller that controls at least one of the AC voltage and an AC current applied by the charging section, and a detector that detects an amount of discharge occurring between the photoconductor and the charging section. The controller controls at least one of the AC voltage and the AC current so that the amount of discharge detected by the detector falls within a predetermined range containing a singularity in change of the amount of discharge.

4 Claims, 8 Drawing Sheets

WHEN CHANGE AMOUNT (Δq) AMONG THREE POINTS (q1, q2, q3) IS EQUAL TO OR LESS THAN PREDETERMINED VALUE

WHEN CHANGE AMOUNT (Δq) AMONG THREE POINTS (q1, q2, q3) IS EQUAL TO OR GREATER THAN PREDETERMINED VALUE

INITIALIZATION PROCESSING (S10)

CHARGING CONTROL PROCESSING (S20)

WHEN CHANGE AMOUNT (Δq) AMONG THREE POINTS (q1, q2, q3) IS EQUAL TO OR LESS THAN PREDETERMINED VALUE

WHEN CHANGE AMOUNT (Δq) AMONG THREE POINTS (q1, q2, q3) IS EQUAL TO OR GREATER THAN PREDETERMINED VALUE

IMAGE FORMATION APPARATUS WITH CONTROLLED DISCHARGE CURRENT

BACKGROUND (i) Technical Field

This invention relates to an image formation apparatus of a printer, a copier, a facsimile, etc.

(ii) Related Art

In this kind of image formation apparatus, a charging device for applying a bias voltage having an AC voltage superposed on a DC voltage is widely used for giving uniform charging to a photoconductor. It is known that if the AC voltage in the bias voltage is lowered to a value at which the photoconductor surface potential becomes the saturation point or less, an image defect (image lack, color change, etc.,) is caused by uneven charging of the photoconductor and the quality in an output image is degraded.

SUMMARY

According to an aspect of the invention, there is provided an image formation apparatus including: a photoconductor; a charging section that applies a bias voltage including an AC voltage superposed on a DC voltage and charges the photoconductor; a controller that controls at least one of the AC voltage and an AC current applied by the charging section; and a detector that detects an amount of discharge occurring between the photoconductor and the charging section, wherein the controller controls at least one of the AC voltage and the AC current so that the amount of discharge detected by the detector falls within a predetermined range containing a singularity in change of the amount of discharge.

BRIEF DESCRIPTION OF THE DRAWINGS

Exemplary embodiments of the present invention will be described in detail based on the following figure, wherein.

DETAILED DESCRIPTION

Referring now to the accompanying drawings, there is shown an exemplary embodiment of the invention.

Figure 1:
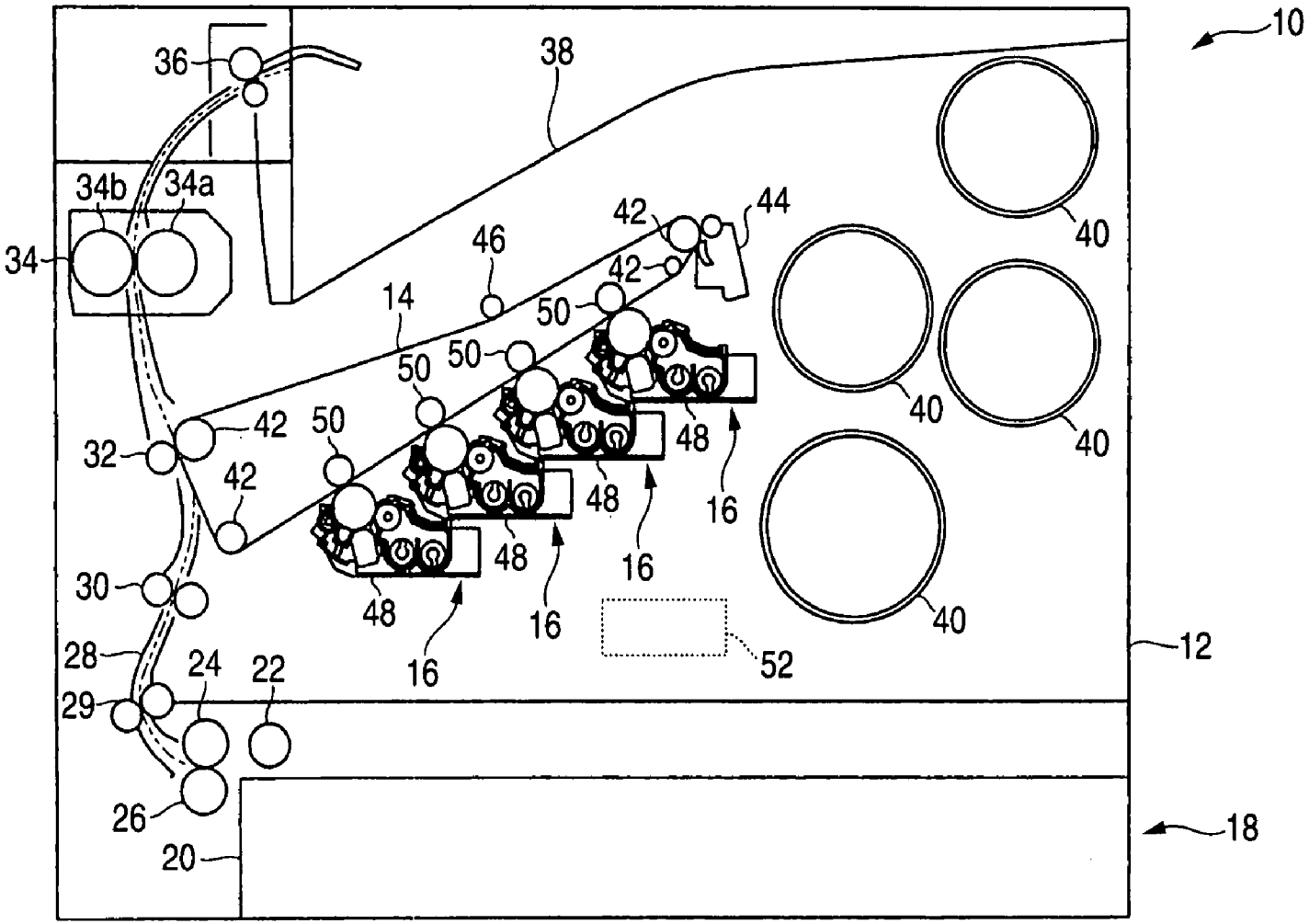
FIG. 1 is a side view to show an image formation apparatus according to an exemplary embodiment of the invention.

FIG. 1 shows an image formation apparatus 10 according to an exemplary embodiment of the invention. This image formation apparatus 10 has an image formation apparatus main unit 12 containing an intermediate transfer belt 14. For example, four image formation sections 16 are placed side by side on the intermediate transfer belt 14, forming the image formation apparatus 10 as a tandem system. The image formation sections 16 form yellow, magenta, cyan, and black toner images on the intermediate transfer belt 14.

A sheet supply unit 18 is provided below the image formation apparatus main unit 12. The sheet supply unit 18 has a sheet supply cassette 20 loaded with sheets, a pickup roll 22 for picking up a sheet loaded on the sheet supply cassette 20, and a feed roll 24 and a retard roll 26 for delivering sheets while separating the sheets. The sheet supply cassette 20 is provided detachably for the image formation apparatus main unit 12 and is loaded with sheets as transfer madia such as plain paper and OHP sheets.

A sheet transportation path 28 is provided almost along the vertical direction in the vicinity of one end of the image formation apparatus main unit 12 (in the vicinity of the left end in the figure). The sheet transportation path 28 is provided with a transport roll 29, a registration roll 30, a second transfer roll 32, a fuser 34, and an ejection roll 36. The registration roll 30 temporarily stops the sheet delivered to the sheet transportation path 28 and sends the sheet to the second transfer roll 32 at a proper timing. The fuser 34 is made up of a heating roll 34*a* and a pressurization roll 34*b* for adding heat and pressure to the sheet passing through the nip between the heating roll 34*a* and the pressurization roll 34*b*, thereby fixing a toner image onto the sheet.

An ejection tray section 38 is provided in the upper part of the image formation apparatus main unit 12. The sheet with the toner image fixed thereon is ejected to the ejection tray section 38 by the ejection roll 36 and is stacked on the ejection tray section 38. Therefore, the sheets in the sheet supply cassette 20 are sequentially ejected to the ejection tray section 38 through the path shaped like a letter C.

For example, four toner bottles 40 are provided on an opposite end side of the image formation apparatus main unit 12 (on the right end side in the figure). The toner bottles 40 store yellow, magenta, cyan, and black toners for supplying the toners to the image formation sections 16 via a toner supply path (not shown).

The intermediate transfer belt 14 is supported on plural transport rolls 42 and the belt face where the image formation sections 16 are provided is inclined relative to the horizontal direction. One of the transport rolls 42 forms a backup roll of the second transfer roll 32. An intermediate belt cleaning device 44 is placed in the proximity of the upper end of the intermediate transfer belt 14 and another one of the transport rolls 42 forms a backup roll of the intermediate belt cleaning device 44. Further, a tension roll 46 is placed in the upper part of the intermediate transfer belt 14 for giving an adequate tension to the intermediate transfer belt 14.

Each of the image formation sections 16 is made up of an image formation unit 48 provided on one face of the intermediate transfer belt 14 and a first transfer roll 50 provided on the back of the intermediate transfer belt 14. The image formation unit 48 is provided detachably for the image formation apparatus main unit 12 and can be drawn out in the front direction in the figure after it is once moved downward.

A controller 52 is disposed in the image formation apparatus main unit 12 for controlling the components of the image formation apparatus main unit 12.

Figure 2:
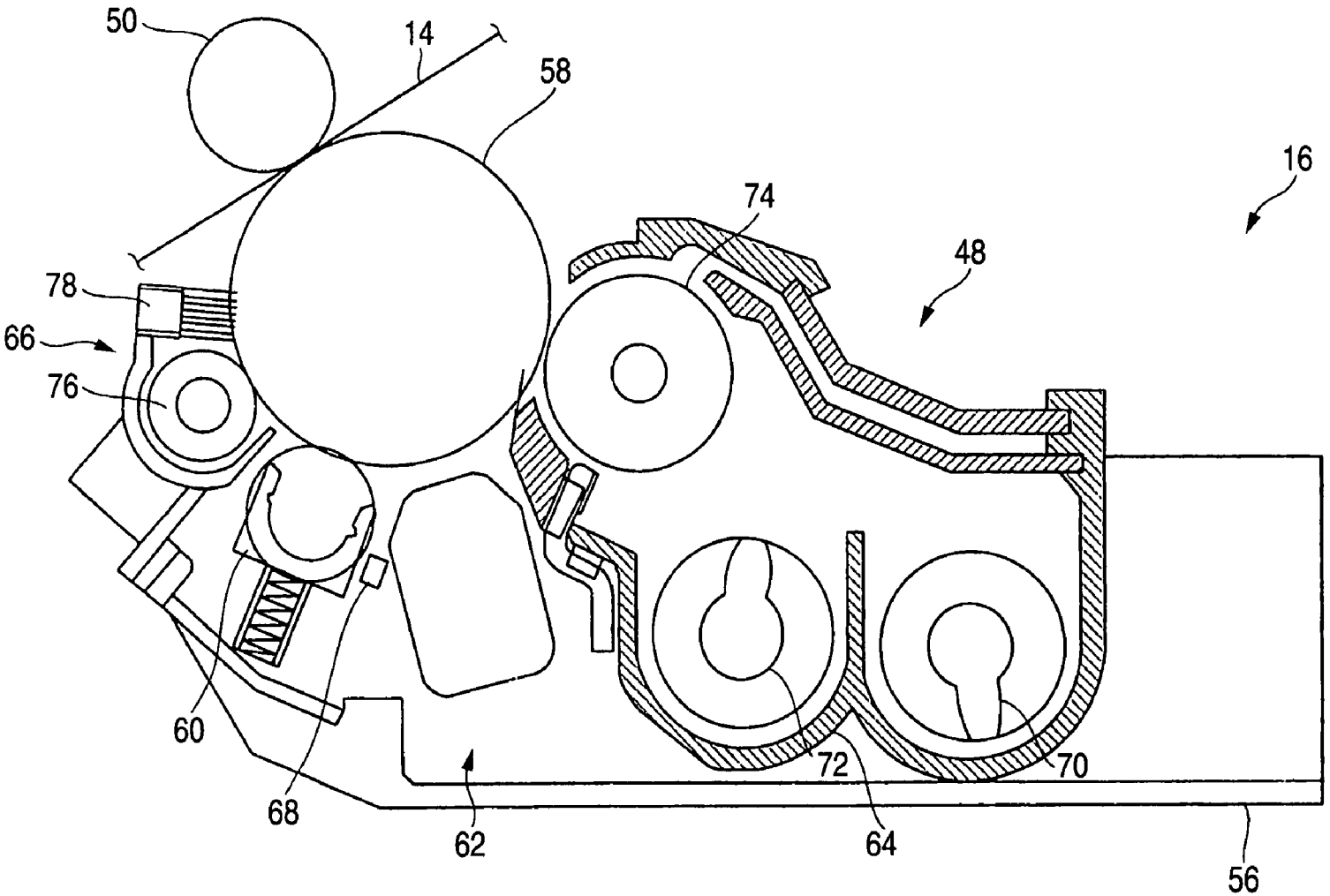
FIG. 2 is a longitudinal sectional view to show an image formation section according to the exemplary embodiment of the invention.

FIG. 2 shows the details of the image formation section 16. The image formation unit 48 has an image formation unit main body 56 and includes a photoconductor 58 opposed to the intermediate transfer belt 14, a charging device 60 implemented as a roll, for example, for charging the photoconductor 58, an exposure device 62 implemented as a light emitting diode (LED), for example, for applying light onto the photoconductor 58 and forming a latent image, a developing device 64 for developing the latent image formed on the photoconductor 58 by the exposure device 62 with toner, and a cleaner 66 for cleaning remaining toner on the photoconductor 58 after transfer, the components being housed in the image formation unit main body 56.

The developing device 64 uses a developer made up of toner and carriers in a two-component system, for example, and has two augers 70 and 72 placed in parallel in a horizontal direction, for example, and a developing roll 74 placed in a slanting direction above the ejection auger 72 for agitating the developer and supplying the developer to the developing roll 74. On the developing roll 74, a magnetic brush of carriers is formed for transporting toner deposited on the carriers and the latent image on the photoconductor 58 is developed with the toner.

The cleaner 66 has a cleaning roll 76 and a cleaning brush 78. The cleaning roll 76 is provided so as to come in contract with the photoconductor 58 and to be able to rotate, and the cleaning brush 78 is placed upstream in the rotation direction of the photoconductor 58 from the cleaning roll 76 so as to come in contact with the photoconductor 58. The cleaning brush 78 attracts the remaining toner deposited on the surface of the photoconductor 58 onto the cleaning brush 78 or scrapes the remaining toner downstream in the rotation direction of the cleaning brush 78 for removing the remaining toner. The cleaning roll 76 attracts the toner not removed by the cleaning brush 78 and remaining on the surface of the photoconductor 58 for removing the remaining toner from the photoconductor 58.

The image formation unit main body 56 is provided with an environmental sensor 68 as a detector for detecting the surrounding environment of the photoconductor 58. The environmental sensor 68 is connected to the controller 52 (shown in FIG. 1) and detects the temperature and the humidity in the surroundings of the photoconductor 58 and outputs the detection result to the controller 52.

In the described configuration, the intermediate transfer belt 14 and the photoconductor 58 rotate in opposite directions in synchronization with each other, the charging device 60 charges the surface of the photoconductor 58, and the exposure device 62 forms a latent image. The latent image formed on the photoconductor 58 by the exposure device 62 is developed by the developing device 64. The toner image developed by the developing device 64 is transferred to the intermediate transfer belt 14 by the first transfer roll 50. The color toner images formed by the image formation section 16 are superposed on each other with a move of the intermediate transfer belt 14.

On the other hand, the sheets stacked in the sheet supply cassette 20 of the sheet supply unit 18 are delivered one at a time to the sheet transportation path 28 by the pickup roll 22, the feed roll 24, the retard roll 26, etc. The sheet delivered to the sheet transportation path 28 abuts the registration roll 30, is temporarily stopped, and is sent to the second transfer roll 32 at a proper timing. The toner image on the intermediate transfer belt 14 is transferred to the sheet by the second transfer roll 32. The sheet to which the toner image is transferred is further sent to the fuser 34, and the toner image is fixed onto the sheet by heat and pressure. The sheet where the toner image is fixed by the fuser 34 is ejected to the ejection tray section 38 by the ejection roll 36.

Next, the photoconductor 58 and the charging device 60 will be discussed in detail.

Figure 3:
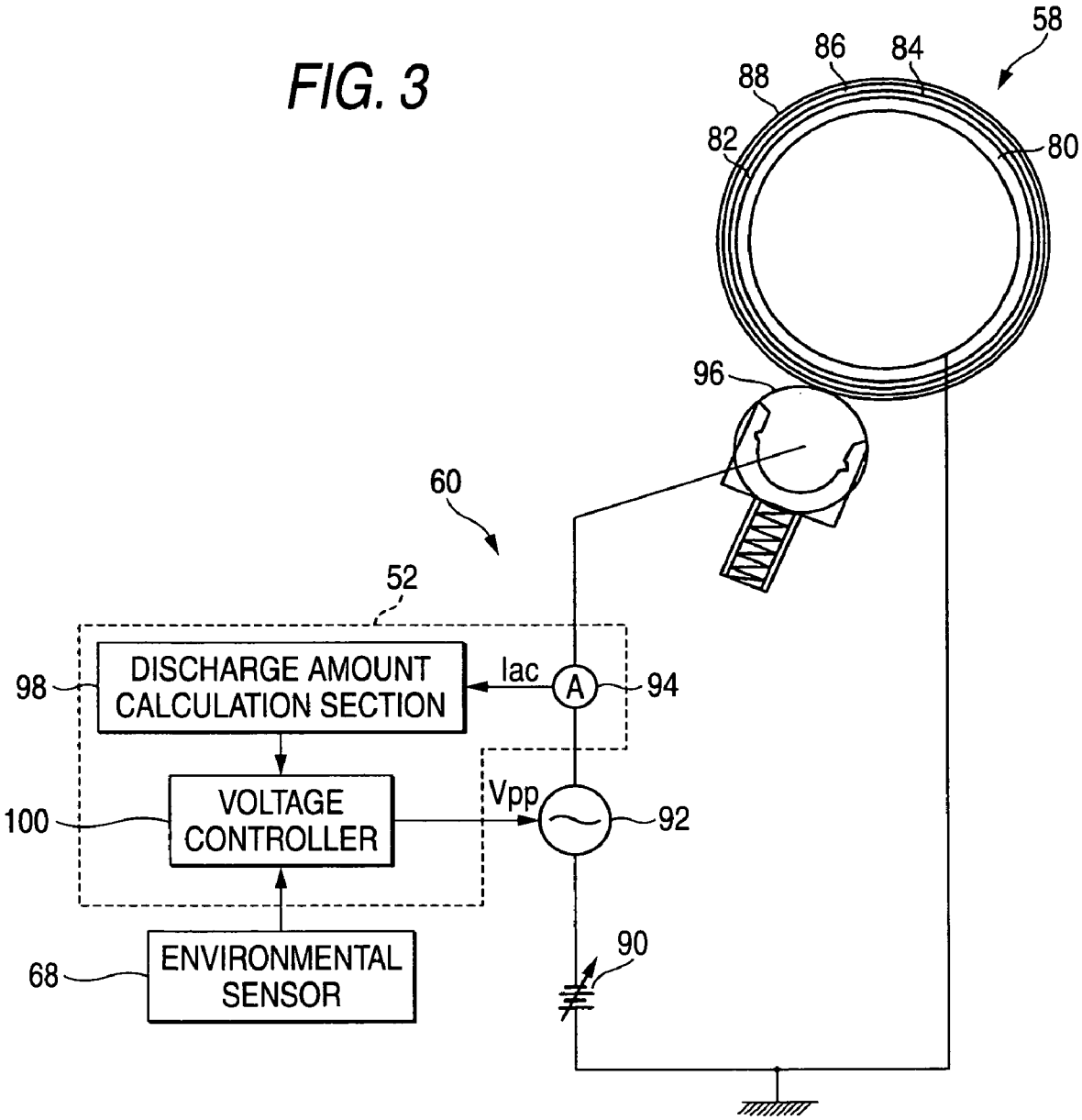
FIG. 3 is a schematic drawing to show the configurations of a photoconductor and a charging device according to the exemplary embodiment of the invention.

FIG. 3 is a drawing to schematically show the configurations of the photoconductor 58 and the charging device 60.

The photoconductor 58 is of layered type and has four layers stacked on a drum substrate 80 made of aluminum, for example. An intermediate layer 82 is stacked on the drum substrate 80 and is used for various functions including electric conduction. A charge generation layer 84 is stacked as a thin layer having a film thickness of 1 μm or less, for example, on the intermediate layer 82 and is a layer with a charge generation material dispersed in a resin binder, for example, in a state of pigment fine particles. A charge transport layer 86 is stacked on the charge generation layer 84 as a film thickness of 15 to 25 μm. for example, and is a layer with a charge transport material dispersed and dissolved in a resin binder. To use a high-hardness material as the surface layer of the photoconductor 58, an image defect like a white spot is caused to occur due to a charging failure and therefore the charge generation layer 84 may have a film thickness of 25 μm or less.

A surface protective layer (surface layer) 88 is stacked on the charge transport layer 86 as a film thickness of 3 to 5 μm, for example, uses a material having high hardness, such as an a-SiN:H film, an a-C:H film not containing Si, or an a-C:H:F film, and has abrasive resistance with the abrasion amount for 1000 revolutions (1K cycle) being 20 nm or less. If a high-hardness material is thus used for the surface protective layer 88, abrasion of the surface layer of the photoconductor 58 is suppressed and a corona product may be deposited on the surface of the photoconductor 58. A method of suppressing the corona product is described later.

The charging device 60 has a DC power supply 90, an AC power supply 92, and a charging roll 96. The DC power supply 90 generates a DC voltage as a DC component of a charge bias power supply. The AC power supply 92 generates an AC component voltage (Vpp: Peak to peak voltage) under the control of the controller 52 and superposes the generated AC voltage (Vpp) on the DC component voltage (DC voltage) generated by the DC power supply 90 to form a charge bias voltage. The charging roll 96 is in contact with the photoconductor 58 for charging the surface of the photoconductor 58 using the charge bias voltage generated by the DC power supply 90 and the AC power supply 92.

The controller 52 has an ammeter 94 as a detector, a discharge amount calculation section 98, and a voltage controller 100. The ammeter 94 detects the value of the current of an AC component (AC current (Iac)) flowing between the photoconductor 58 and the charging device 60 and outputs the current value to the discharge amount calculation section 98. The discharge amount calculation section 98 calculates an amount of discharge Q based on the AC current (Iac) and outputs the calculation result to the voltage controller 100. The voltage controller 100 controls the AC voltage (Vpp) based on the amount of discharge Q output from the discharge amount calculation section 98 and the temperature value and the humidity value output from the environmental sensor 68.

Figure 4A:
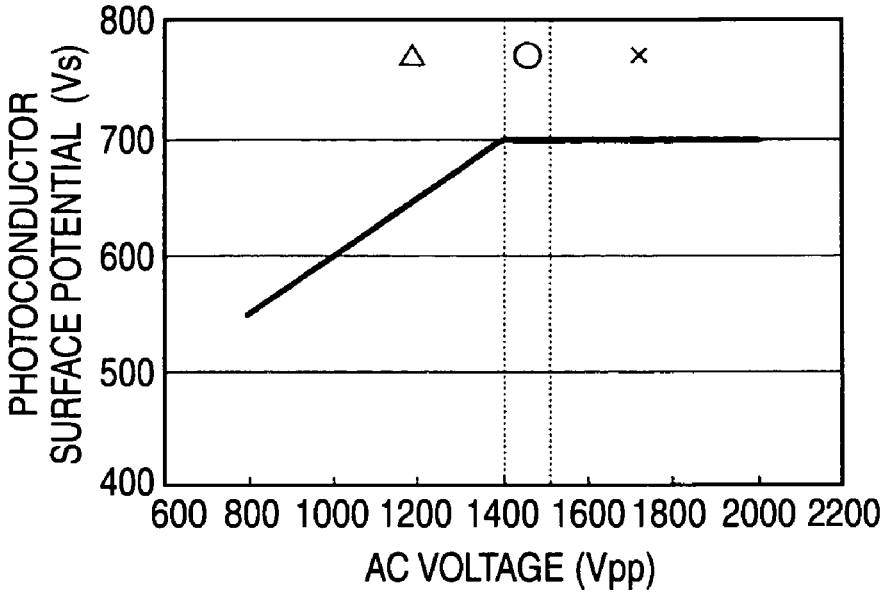
FIG. 4A is a graph to show the relationship between AC voltage (Vpp) and photoconductor surface potential as for charging of the photoconductor according to the exemplary embodiment of the invention.

FIG. 4A shows the relationship between the AC voltage (Vpp) and a surface potential (Vs) of the photoconductor 58.

As shown in FIG. 4A, if the AC voltage (Vpp) is increased, the surface potential (Vs) of the photoconductor 58 increases linearly and then is saturated. If the AC voltage (Vpp) is equal to or less than the saturation point of the surface potential (Vs) of the photoconductor 58 (area represented by Δ in FIG. 4A), uneven charging easily occurs on the surface of the photoconductor 58 (shown in FIG. 3). Even if the AC voltage (Vpp) is equal to or greater than the saturation point of the surface potential (Vs) of the photoconductor 58, when it exceeds a predetermined value (area represented by X in FIG. 4A), a corona product occurs and is deposited on the surface of the photoconductor 58. Therefore, the AC voltage (Vpp) needs to be controlled within the range of the lower limit where uneven charging does not substantially occur to the upper limit where a corona product does not substantially occur, namely, within a predetermined range equal to or greater than the saturation point of the surface potential (Vs) of the photoconductor 58 (area represented by o in FIG. 4A).

Figure 5:
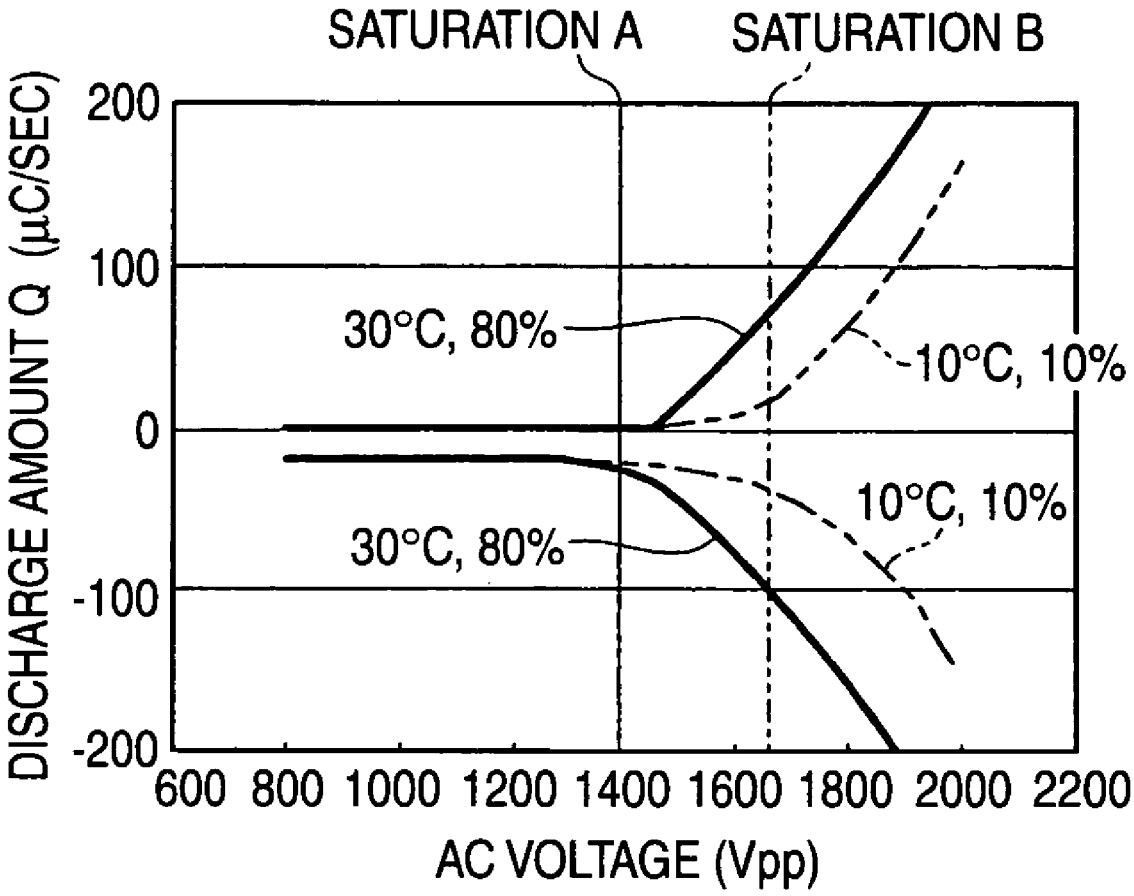
FIG. 5 is a graph to show the relationship between AC voltage (Vpp) and amount of discharge Q in change of temperature and humidity as for charging of the photoconductor according to the exemplary embodiment of the invention.

The saturation point of the surface potential (Vs) of the photoconductor 58 also has a characteristic of changing with the temperature and the humidity in the image formation apparatus main unit 12. For example, saturation point A shown in FIG. 5 indicates the relationship between the AC voltage (Vpp) and the amount of discharge Q when the temperature is 30° C. and the humidity is 80%, and saturation point B indicates the relationship between the AC voltage (Vpp) and the amount of discharge Q when the temperature is 10° C. and the humidity is 10%. That is, the saturation point moves to lower AC voltage (Vpp) (in the left direction in FIG. 4A) when the temperature and the humidity are high, and the saturation point moves to higher AC voltage (Vpp) (in the right direction in FIG. 4A) when the temperature and the humidity are low.

Figure 4B:
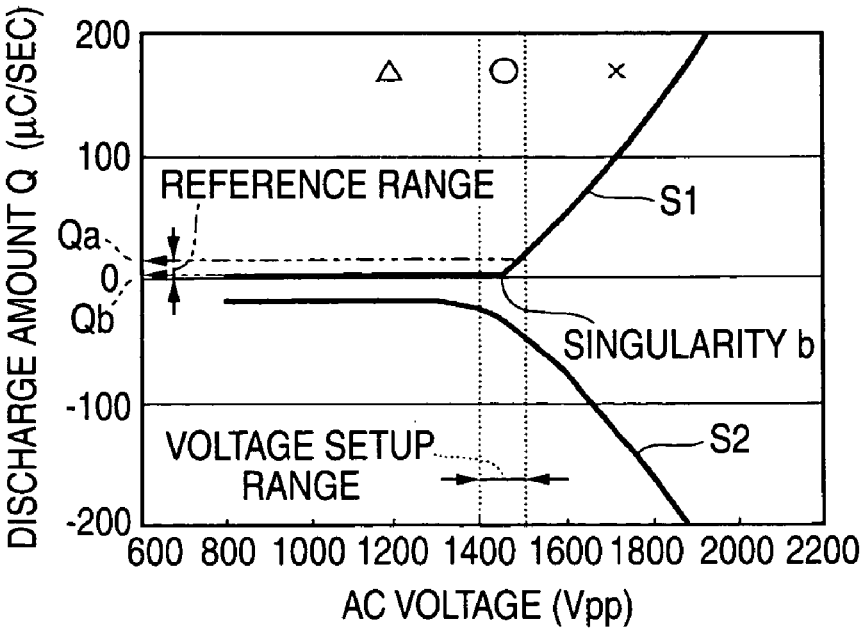
FIG. 4B is a graph to show the relationship between AC voltage (Vpp) and amount of discharge Q as for charging of the photoconductor according to the exemplary embodiment of the invention.

FIG. 4B shows the relationship between the AC voltage (Vpp) and the amount of discharge Q.

As shown in FIG. 4B, if the AC voltage (Vpp) is increased, when it exceeds a predetermined voltage, a discharge phenomenon occurs and a pulse-like discharge current flows between the charging roll 96 (shown in FIG. 3) and the photoconductor 58. The discharge current occurs on both the plus side (the upper side in FIG. 4B: Curve S1) and the minus side (the lower side in FIG. 4B: Curve S2) of the AC current (Iac) flowing between the charging roll 96 and the photoconductor 58. Comparing the change (curve S1 in FIG. 4) in the amount of discharge (discharge current) Q on the plus side at the time with FIG. 4A, when the surface potential (Vs) of the photoconductor 58 is equal to or less than the saturation point (for example, the area represented by A in FIG. 4B), the amount of discharge Q maintains the value in the proximity of 0 (μC/sec) and rises exceeding a predetermined voltage (singularity b in FIG. 4B) in the vicinity of the saturation point of the surface potential (Vs) of the photoconductor 58 (area represented by o in FIG. 4B) and if the AC voltage (Vpp) is further increased (area represented by X in FIG. 4B), the amount of discharge Q continues to rise. Here, the singularity is a point at which one nature is not held; in the example, it refers to a point at which the amount of discharge Q does not maintain the value in the proximity of 0 (μC/sec), namely, a point at which a discharge current (amount of discharge Q) starts to flow between the charging roll 96 and the photoconductor 58.

Using the characteristic in the change of the amount of discharge Q relative to the AC voltage (Vpp), the AC voltage (Vpp) is controlled in the range of the lower limit where uneven charging does not substantially occur to the upper limit where a corona product does not substantially occur. Specifically, the AC voltage (Vpp) is controlled so as to be in the voltage setup range (for example, shown in FIG. 4) in which the amount of discharge Q is in a predetermined reference range containing the singularity b (for example, Qb to Qa in FIG. 4B).

The reference range in the amount of discharge Q can be determined as follows: The reference range is the range in which the amount of discharge Q is equal to or greater than the singularity b (Qb in FIG. 4) and is equal to or less than the predetermined charge amount (Qa in FIG. 4) in the change of the amount of discharge Q relative to the change of the AC voltage (Vpp) (the curve S1 in FIG. 4B).

Alternatively, the change amount of the amount of discharge Q if the AC voltage (Vpp) is increased is referenced in sequence and a given area based on the point at which the change amount of the amount of discharge Q changes, namely, the singularity b (Qb in FIG. 4) maybe set to the reference range, or the singularity b itself may be adopted as the reference range.

On the other hand, if the temperature in atmosphere is low, an image defect caused by a corona product does not occur. However, particularly if the charge transport layer of the photoconductor has a thickness of 25 μm or more and the applied AC current and voltage are in the vicinity of the singularity of the amount of discharge, an image defect like a white spot is caused to occur due to a charging failure. Thus, the applied AC current and voltage are controlled so as to become AC current and voltage resulting from multiplying the AC current and voltage at the singularity b of the amount of discharge Q by a predetermined value. Alternatively, the applied AC current and voltage are controlled so as to become AC current and voltage resulting from adding a predetermined value to the AC current and voltage at the singularity b of the amount of discharge Q. The value by which the AC current and voltage are multiplied or the value added to the AC current and voltage is determined empirically from the white spot occurrence situation and is stored in storage (not shown) of the image formation apparatus main unit 12 or memory (not shown) in the image formation unit main body 56.

Next, a setting method of the AC voltage (Vpp) in the controller 52 will be discussed.

Figure 6:
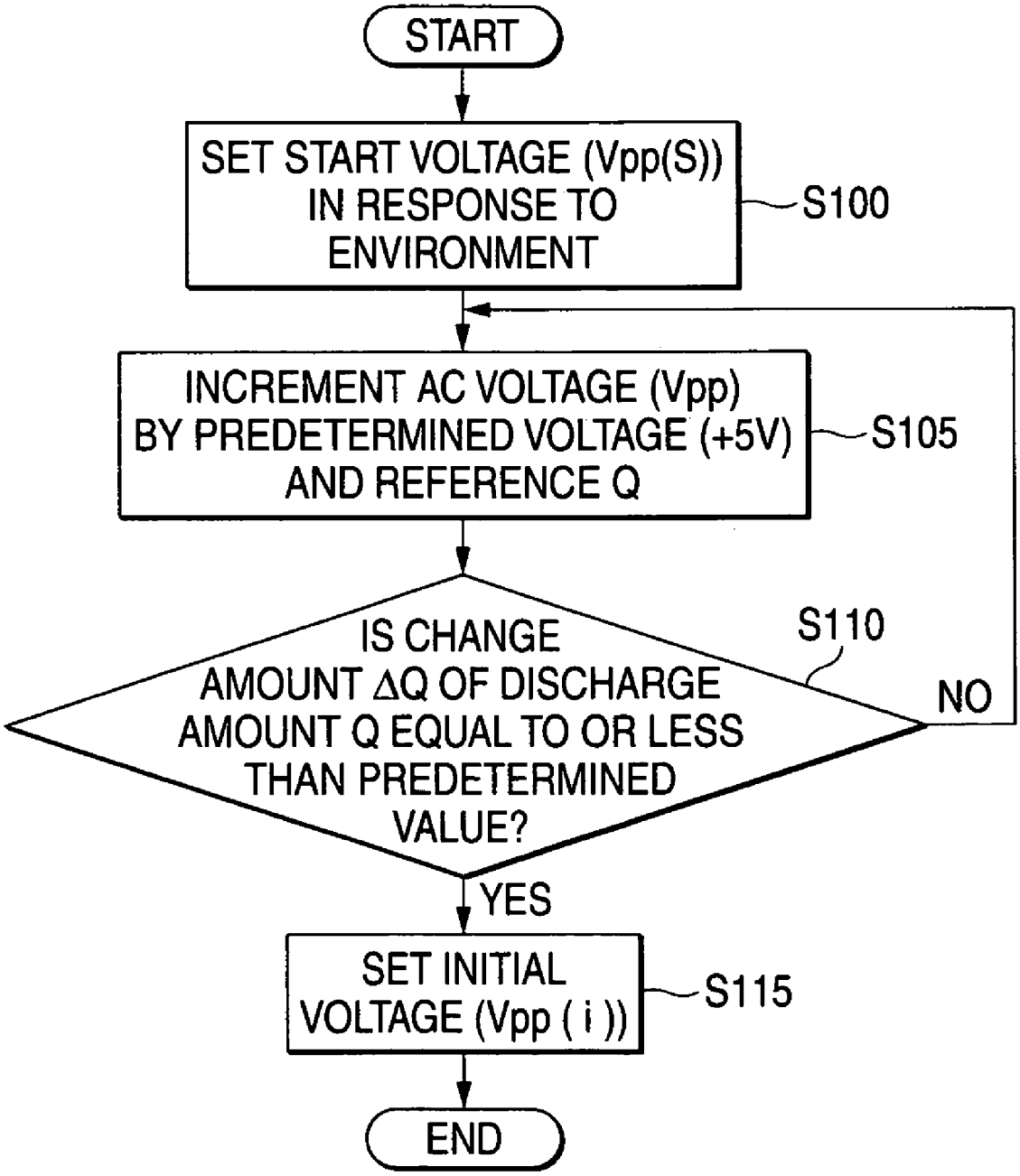
FIG. 6 is a flowchart to describe initialization processing of AC voltage (Vpp) in the charging device according to the exemplary embodiment of the invention.

FIG. 6 is a flowchart to describe initialization processing (S10). The initialization processing (S10) is performed before usual print processing.

As shown in FIG. 6, at step S100, the controller 52 sets start voltage (Vpp (s)) based on the temperature value and the humidity value output from the environmental sensor 68 (for example, the start voltage (Vpp(s)) under the conditions of temperature 30° C. and humidity 80% is 1100 V).

The start voltage (Vpp(s)) is thus set according to the output values of the environmental sensor 68, whereby the time to setting of initial voltage (Vpp(i)) described later (standby time) is shortened and if the saturation point of the surface potential (Vs) of the photoconductor 58 changes due to the temperature and the humidity in the image formation apparatus main unit 12, the optimum start voltage (Vpp(s)) can be set.

At step S105, the controller 52 increments the initial voltage (Vpp(i)) by a predetermined voltage (for example, 5 V)

and references the AC current (Iac) output by the ammeter 94 at this time and calculates the amount of discharge Q by the discharge amount calculation section 98.

At step S110, the controller 52 determines whether or not the change amount (ΔQ) of the amount of discharge Q referenced at step S105 is equal to or less than a predetermined value. If the change amount is equal to or less than the predetermined value, the controller 52 goes to step S115; otherwise, the controller 52 returns to step S105. The change amount (ΔQ) of the amount of discharge Q is the difference between the amounts of discharge Q before and after the voltage is incremented by a predetermined voltage (for example, 5 V).

At step S115, the controller 52 sets the AC voltage (Vpp) corresponding to the fluctuation width (ΔIdc) of the DC current referenced at step S105 to the initial voltage (Vpp(i)).

Thus, the controller 52 repeats the processing at steps S105 and S110 a predetermined number of times, thereby incrementing the AC voltage (Vpp) by a predetermined voltage (for example, 5 V) from the start voltage (Vpp (s)) and setting the initial voltage (Vpp(i)) used in charging control processing (S20) described later.

Figure 7:
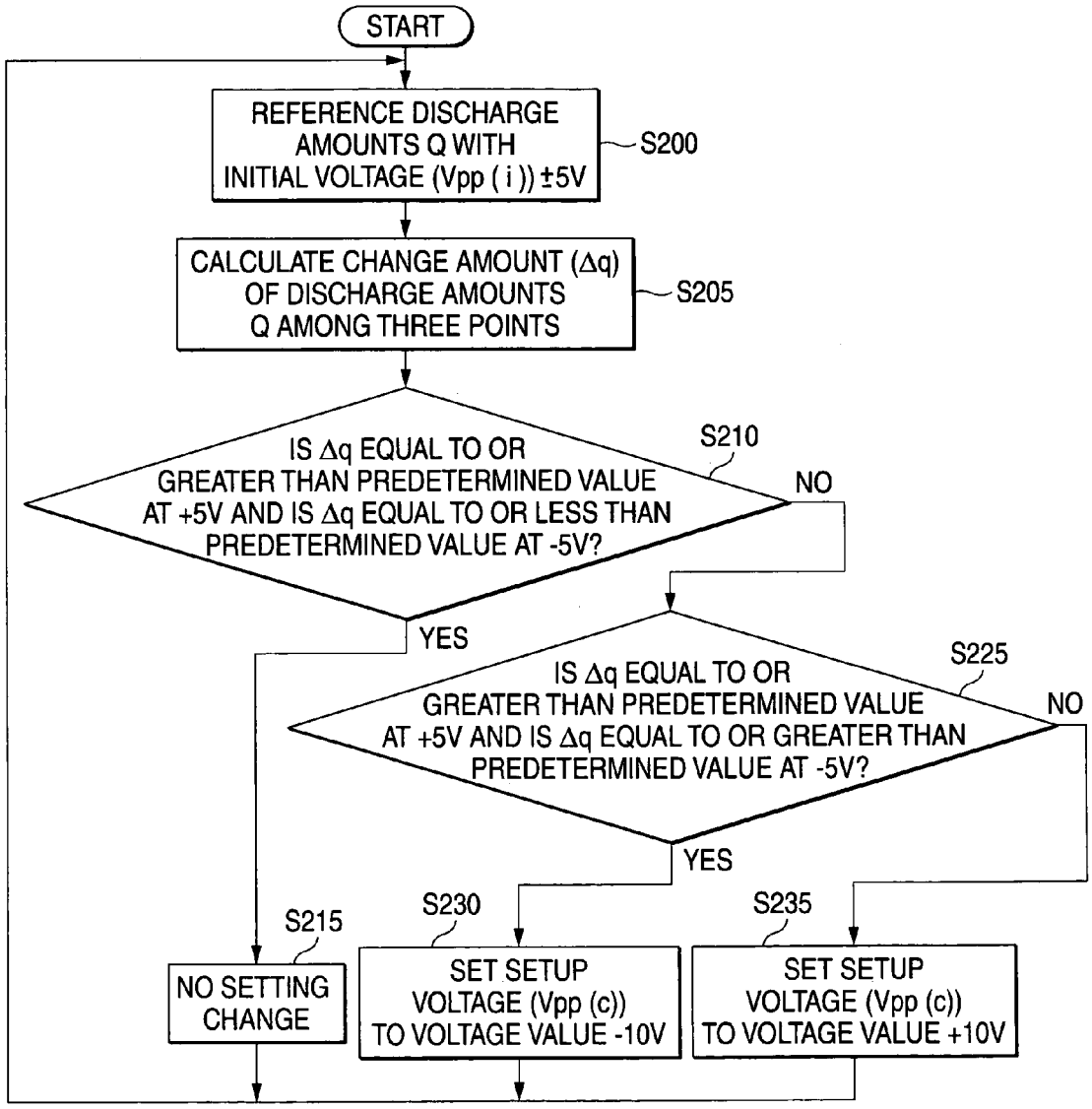
FIG. 7 is a flowchart to describe charging control processing of the charging device according to the exemplary embodiment of the invention.

FIG. 7 is a flowchart to describe the charging control processing (S20). The charging control processing (S20) is performed at usual print processing time.

As shown in FIG. 7, at step S200, the controller 52 changes the AC voltage (Vpp) by predetermined voltages (for example, 5 V to the plus side and 5 V to the minus side) with the initial voltage (Vpp(i)) set according to the initialization processing (S10) described above as the center, and references the amounts of discharge Q calculated based on the AC current (Iac) output by the ammeter 94 at the time.

Figure 8A:
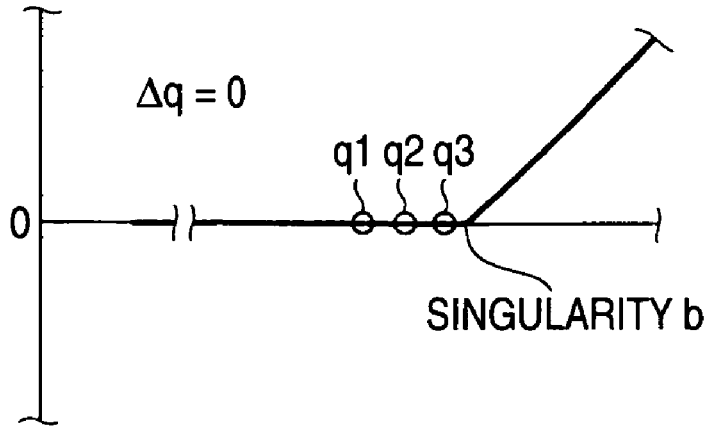
FIG. 8A is graphs to show the relationship between AC voltage (Vpp) and amount of discharge Q in charging of the photoconductor according to the exemplary embodiment of the invention and show an example wherein change amount (Δq) among three points of amount of discharge Q is equal to or less than predetermined value.
Figure 8B:
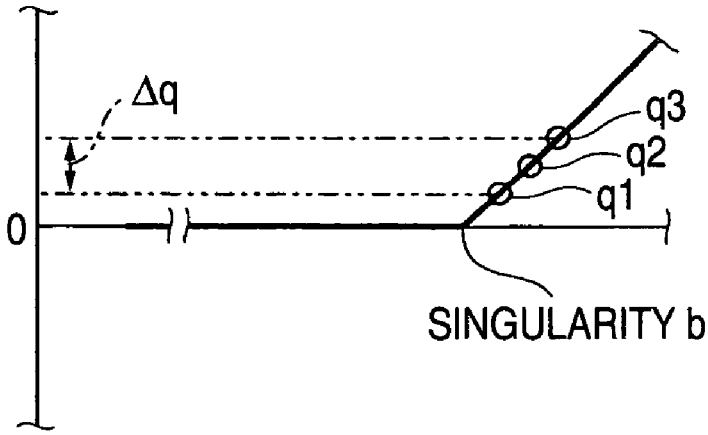
FIG. 8B is graphs to show the relationship between AC voltage (Vpp) and amount of discharge Q in charging of the photoconductor according to the exemplary embodiment of the invention and show an example wherein change amount (Δq) among three points of amount of discharge Q is equal to or greater than predetermined value.

At step S205, the controller 52 references the amounts of discharge Q at predetermined three points, for example, with the predetermined voltages (for example, 5 V to the plus side and 5 V to the minus side) used at step S200 as the center, and finds the change amount (Δq) of the amounts of discharge Q among the three points. The change amount (Δq) of the amounts of discharge Q changes with the singularity b as the reference according to the positions of the predetermined three points, as shown in FIG. 8.

At step S210, if the change amount (Δq) of the amounts of discharge Q among the predetermined three points when the AC voltage (Vpp) is changed to the plus side (for example, +5 V) at step S200 is equal to or greater than a predetermined value (for example, FIG. 8B) and if the change amount (Δq) of the amounts of discharge Q among the predetermined three points when the AC voltage (Vpp) is changed to the minus side (for example, −5 V) is equal to or less than the predetermined value (for example, FIG. 8A), the controller 52 goes to step S215, otherwise, the controller 52 goes to step S225.

At step S215, the controller 52 adopts the initial voltage (Vpp (i)) described above as a setup voltage (Vpp (c)). That is, since the change amount (Δq) of the amounts of discharge Q among the predetermined three points when the AC voltage (Vpp) is changed to the plus side (for example, +5 V) is equal to or greater than the predetermined value and the change amount (Δq) of the amounts of discharge Q among the predetermined three points when the AC voltage (Vpp) is changed to the minus side (for example, −5 V) is equal to or less than the predetermined value, the controller 52 determines that the initial voltage (Vpp(i)) is in the proximity of the singularity b within the voltage setup range (shown in FIG. 4B), and does not change the setting of the AC voltage (Vpp).

At step S225, if the change amount (Δq) of the amounts of discharge Q among the predetermined three points when the AC voltage (Vpp) is changed to the plus side (for example, +5 V) at step S200 is equal to or greater than the predetermined value (for example, FIG. 8B) and if the change amount (Δq) of the amounts of discharge Q among the predetermined three points when the AC voltage (Vpp) is changed to the minus side (for example, −5 V) is equal to or greater than the predetermined value (for example, FIG. 8B), the controller 52 goes to step S230, otherwise, the controller 52 goes to step S225.

At step S230, the controller 52 adopts the voltage value resulting from subtracting a predetermined voltage (for example, 10 V) from the initial voltage (Vpp(i)) described above as the setup voltage (Vpp(c)). That is, if the change amount (Δq) of the amounts of discharge Q among the predetermined three points is equal to or greater than the predetermined value (for example, FIG. 8B) although the AC voltage (Vpp) is changed by predetermined voltages (for example, 5 V to the plus side and 5 V to the minus side) with the initial voltage (Vpp(i)) as the center, the controller 52 determines that the initial voltage (Vpp(i)) is in the proximity of the upper limit of the voltage setup range (shown in FIG. 4B), and decrements the setup value of the AC voltage (Vpp).

At step S235, the controller 52 adopts the voltage value resulting from adding a predetermined voltage (for example, 10 V) to the initial voltage (Vpp(i)) described above as the setup voltage (Vpp(c)). That is, if the change amount (Δq) of the amounts of discharge Q among the predetermined three points is equal to or less than the predetermined value (for example, FIG. 8A) although the AC voltage (Vpp) is changed by predetermined voltages (for example, 5 V to the plus side and 5 V to the minus side) with the initial voltage (Vpp(i)) as the center, the controller 52 determines that the initial voltage (Vpp(i)) is in the proximity of the lower limit of the voltage setup range (shown in FIG. 4B), and increments the setup value of the AC voltage (Vpp).

At S200, the AC voltage (Vpp) is changed by predetermined voltages with the initial voltage (Vpp(i)) set according to the initialization processing (S10) as the center. After the setup voltage (Vpp(c)) is set at step S215, step S230, or step S235, the voltage is changed by predetermined voltages with the setup voltage (Vpp(c)) as the center and further at step S210 and step S225, a comparison is made between the change amount (Δq) of the amounts of discharge Q among the predetermined three points corresponding to change of the setup voltage (Vpp(c)) and the predetermined value for determination.

Thus, the controller 52 repeats the processing at steps S200 to S215, step S230, and step S235 for controlling so that the setup voltage (Vpp(c)) is in the proximity of the singularity b in the voltage setup range.

In the exemplary embodiment, the AC voltage (Vpp) is used for the charging control of the controller 52, but the invention is not limited thereto and the AC current (Iac) may be controlled.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation apparatus comprising:

a photoconductor;

a charging section that applies a bias voltage comprising an AC voltage superposed on a DC voltage and charges the photoconductor;

a controller that controls at least one of the AC voltage and an AC current applied by the charging section; and a detector that detects an amount of discharge occurring between the photoconductor and the charging section, wherein the controller controls at least one of the AC voltage and the AC current so that the amount of discharge detected by the detector becomes a singularity in change of the amount of discharge, and the controller determines whether the amount of discharge becomes the singularity or not by comparing the amount of discharge at three levels including a first level, a second level and a third level, the first level being a given AC voltage level or a given AC current level, the second level being obtained by adding the first level and a given value, the third level being obtained by subtracting the given value from the first level.

2. The image formation apparatus as claimed in claim 1, wherein the detector detects the amount of discharge occurring on a plus side of the AC current flowing between the photoconductor and the charging section.

3. The image formation apparatus as claimed in claim 1, wherein an abrasion amount of an outer layer of the photoconductor for 1000 revolutions thereof is about 20 nm or less.

4. The image formation apparatus as claimed in claim 1, wherein the photoconductor comprises a charge transport layer, and the charge transport layer has a thickness of about 25 μm or less.

* * * * *